US010547942B2

(12) United States Patent
Brunet et al.

(10) Patent No.: US 10,547,942 B2
(45) Date of Patent: Jan. 28, 2020

(54) CONTROL OF ELECTRODYNAMIC SPEAKER DRIVER USING A LOW-ORDER NON-LINEAR MODEL

(71) Applicant: Samsung Electronics Co., Ltd., Suwon-si, Gyeonggi-do (KR)

(72) Inventors: Pascal M. Brunet, Pasadena, CA (US); Allan Devantier, Newhall, CA (US)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 320 days.

(21) Appl. No.: 15/391,633

(22) Filed: Dec. 27, 2016

(65) Prior Publication Data

US 2017/0188150 A1 Jun. 29, 2017

Related U.S. Application Data

(60) Provisional application No. 62/271,590, filed on Dec. 28, 2015.

(51) Int. Cl.

| | |
|---|---|
| ***H04R 3/08*** | (2006.01) |
| *H04R 29/00* | (2006.01) |
| *H04R 3/00* | (2006.01) |

(52) U.S. Cl.

CPC ..... *H04R 3/08* (2013.01); *H04R 3/007* (2013.01); *H04R 29/003* (2013.01); *H04R 2499/11* (2013.01)

(58) Field of Classification Search

CPC ..... H04R 3/002; H04R 3/04; H04R 29/001; H04R 3/007; H04R 3/08; H04R 2499/11; H04R 29/003

USPC ..... 381/55–56, 58–59, 96, 189

See application file for complete search history.

(56) References Cited

U.S. PATENT DOCUMENTS

| | | | |
|---|---|---|---|
| 5,600,718 | A | 2/1997 | Dent et al. |
| 5,870,484 | A | 2/1999 | Greenberger et al. |
| 6,059,926 | A | 5/2000 | Hiroshima |
| 6,275,592 | B1 | 8/2001 | Vartiainen |
| 7,024,014 | B1 | 4/2006 | Noll |
| 7,348,908 | B2 | 3/2008 | Slavin |
| 7,359,519 | B2 | 4/2008 | Lee et al. |
| 7,372,966 | B2 | 5/2008 | Bright |
| 7,467,071 | B2 | 12/2008 | Manrique et al. |
| 7,477,751 | B2 | 1/2009 | Lyon et al. |

(Continued)

FOREIGN PATENT DOCUMENTS

| | | |
|---|---|---|
| EP | 0548836 B1 | 11/1997 |
| EP | 1799013 B1 | 2/2010 |

(Continued)

OTHER PUBLICATIONS

International Search Report and Written Opinion dated Apr. 20, 2018 for International Application PCT/KR2018/000016 from Korean Intellectual Property Office, pp. 1-5, Republic of Korea.

(Continued)

*Primary Examiner* — Rasha S Al Aubaidi

(74) *Attorney, Agent, or Firm* — Sherman IP LLP; Kenneth L. Sherman; Steven Laut

(57) ABSTRACT

A speaker system includes a speaker driver configured to cause speaker cone displacement based on a driver voltage input. A controller is configured to generate the driver voltage input to the speaker driver. The controller includes: a feedforward control path configured to generate a nominal voltage input based on a nonlinear model of electroacoustic dynamics of the speaker driver and an input audio signal.

18 Claims, 6 Drawing Sheets

(56) References Cited

U.S. PATENT DOCUMENTS

| | | | |
|---|---|---|---|
| 7,688,964 | B2 | 3/2010 | De Callafon |
| 8,073,149 | B2 | 12/2011 | Kuze |
| 8,086,956 | B2 | 12/2011 | Su et al. |
| 8,130,994 | B2 | 3/2012 | Button et al. |
| 8,146,989 | B2 | 4/2012 | Godiska et al. |
| 8,204,210 | B2 | 6/2012 | van de Laar et al. |
| 8,300,837 | B2 | 10/2012 | Shmunk |
| 8,391,498 | B2 | 3/2013 | Potard |
| 8,538,040 | B2 | 9/2013 | Kirn |
| 8,855,322 | B2 | 10/2014 | Ryu et al. |
| 8,938,084 | B2 | 1/2015 | Arai |
| 9,042,561 | B2 | 5/2015 | Gautama et al. |
| 9,130,527 | B2 | 9/2015 | Potard |
| 9,154,101 | B2 | 10/2015 | Dhuyvetter |
| 9,161,126 | B2 | 10/2015 | Su et al. |
| 9,374,634 | B2 | 6/2016 | Macours et al. |
| 9,432,771 | B2 | 8/2016 | Oyetunji et al. |
| 9,553,554 | B2 | 1/2017 | Kimura et al. |
| 9,578,416 | B2 | 2/2017 | Gautama et al. |
| 9,635,454 | B2 | 4/2017 | Larrien |
| 9,661,428 | B2 | 5/2017 | Holladay et al. |
| 9,837,971 | B2 | 12/2017 | Luo et al. |
| 9,883,305 | B2 | 1/2018 | Risberg et al. |
| 9,900,690 | B2 | 2/2018 | Risberg et al. |
| 9,967,652 | B2 | 5/2018 | Baird et al. |
| 9,980,068 | B2 | 5/2018 | Berthelsen et al. |
| 9,992,571 | B2 | 6/2018 | Hu |
| 10,219,090 | B2 | 2/2019 | Adams et al. |
| 2002/0141098 | A1 | 10/2002 | Schlager |
| 2004/0028242 | A1 | 2/2004 | Kitamura |
| 2005/0122166 | A1 | 6/2005 | Premakanthan et al. |
| 2006/0274904 | A1 | 12/2006 | Lashkari |
| 2007/0098190 | A1 | 5/2007 | Song et al. |
| 2009/0180636 | A1 | 7/2009 | Su et al. |
| 2011/0182435 | A1 | 7/2011 | Gautama |
| 2012/0203526 | A1 | 8/2012 | Bai et al. |
| 2012/0289809 | A1 | 11/2012 | Kaib et al. |
| 2013/0094657 | A1 | 4/2013 | Brammer et al. |
| 2014/0051483 | A1 | 2/2014 | Schoerkmaier |
| 2014/0254827 | A1 | 9/2014 | Bailey et al. |
| 2014/0286500 | A1 | 9/2014 | Iwamoto et al. |
| 2015/0010171 | A1 | 1/2015 | Pernici et al. |
| 2015/0281844 | A1 | 10/2015 | Stabile |
| 2015/0319529 | A1 | 11/2015 | Klippel et al. |
| 2016/0134982 | A1 | 5/2016 | Iyer |
| 2016/0360331 | A1 | 12/2016 | Yeh |
| 2016/0373858 | A1 | 12/2016 | Lawrence et al. |
| 2017/0055067 | A1 | 2/2017 | Moro et al. |
| 2017/0188150 | A1 | 6/2017 | Brunet et al. |
| 2017/0272045 | A1 | 9/2017 | Chadha |
| 2017/0280240 | A1 | 9/2017 | Hu |
| 2017/0318388 | A1 | 11/2017 | Risberg et al. |
| 2017/0345438 | A1 | 11/2017 | Thyssen |
| 2018/0014120 | A1 | 1/2018 | Lawrence et al. |
| 2018/0034430 | A1 | 2/2018 | Ahmed et al. |
| 2018/0192192 | A1 | 7/2018 | Brunet et al. |
| 2019/0222939 | A1 | 7/2019 | Brunet et al. |
| 2019/0281385 | A1 | 9/2019 | Brunet et al. |

FOREIGN PATENT DOCUMENTS

| | | | |
|---|---|---|---|
| EP | 2642769 | A1 | 9/2013 |
| EP | 3079375 | A1 | 10/2016 |
| JP | 3433342 | B2 | 8/2003 |
| JP | 2004312141 | A | 11/2004 |
| JP | 2005129977 | A | 5/2005 |
| JP | 2007060648 | A | 3/2007 |
| JP | 2007081815 | A | 3/2007 |
| JP | 2015082754 | A | 4/2015 |
| JP | 2015084499 | A | 4/2015 |
| JP | 6182869 | B2 | 8/2017 |
| KR | 10-20050023841 | A | 3/2005 |
| KR | 10-20140097874 | A | 8/2014 |
| KR | 101445186 | B1 | 10/2014 |
| WO | 2013182901 | A1 | 12/2013 |
| WO | 2014045123 | A | 3/2014 |
| WO | 2015143127 | A | 9/2015 |
| WO | 2015191691 | A1 | 12/2015 |
| WO | 2017088876 | A2 | 6/2017 |

OTHER PUBLICATIONS

U.S. Non-Final Office Action for U.S. Appl. No. 15/835,245 dated Jun. 14, 2018.

International Search Report and Written Opinion dated Mar. 31, 2017 for International Application PCT/KR2016/015435 from Korean Intellectual Property Office, pp. 1-12, Republic of Korea.

Thomsen, S. et. al., "Design and Analysis of a Flatness-Based Control Approach for Speed Control of Drive Systems with Elastic Couplings and Uncertain Loads," Proceedings of the 2011-14th European Conference (EPE 2011), Aug. 30-Sep. 1, 2011; pp. 1-10, IEEE Press, United States.

Fliess, M. et al., "Flatness and Defect of Nonlinear Systems: Introductory Theory and Examples", International Journal of Control, Jun. 1995, pp. 1327-1361, vol. 61, Taylor & Francis, United Kingdom.

Papazoglou, N. et al., "Linearisation par Asservissement d'unhautparleur electrodynamique: approche par les Systemes Hamiltoniens a Ports", Memoire De Fin D Etude M2R SAR Parcourt ATIAM, pp, 1-52, Aug. 11, 2014.

Extended European Search Report dated Jul. 23, 2018 for European Application No. 16882101.5 from European Patent Office, pp. 1-8, Munich, Germany.

Hu, Y. et al., "Effects of the Cone and Edge on the Acoustic Characteristics of a Cone Loudspeaker", Advances in Acoustics and Vibration, May 21, 2017, pp. 1-12, vol. 2017, Hindawi, Japan.

Salvatti, A. et al., "Maximizing performance from loudspeaker ports," Journal of the Audio Engineering Society, Jan./Feb. 2002, pp. 19-45, v. 50, No. 1/2, United States.

U.S. Advisory Action for U.S. Appl. No. 15/835,245 dated Apr. 11, 2019.

International Search Report and Written Opinion dated Apr. 29, 2019 for International Application PCT/KR2019/000702 from Korean Intellectual Property Office, pp. 1-10, Republic of Korea.

U.S. Notice of Allowance for U.S. Appl. No. 15/835,245 dated May 6, 2019.

International Search Report dated Jun. 21, 2019 for International Application PCT/KR2019/002741 from Korean Intellectual Property Office, pp. 1-3, Republic of Korea.

U.S. Supplemental Notice of Allowability for U.S. Appl. No. 15/835,245 dated Aug. 28, 2019.

U.S. Notice of Allowability for U.S. Appl. No. 15/873,530 dated Aug. 28, 2019.

U.S. Notice of Allowability for U.S. Appl. No. 15/873,530 dated Sep. 9, 2019.

ProSoundWeb, "Harman Unveils JBL 3 Series Mk II Powered Studio Monitors," Jan. 2018, pp. 1-4, EH Publishing, United States, downloaded at: https://www.prosoundweb.com/channels/recording/harman-unveils-jbl-3-series-mkii-powered-studio-monitors/.

International Search Report and Written Opinion dated May 7, 2019 for International Application PCT/KR2019/001090 from Korean Intellectual Property Office, pp. 1-13, Republic of Korea.

U.S. Supplemental Notice of Allowability for U.S. Appl. No. 15/835,245 dated Jul. 15, 2019.

U.S. Notice of Allowance for U.S. Appl. No. 15/873,530 dated Jul. 18, 2019.

U.S. Final Office Action for U.S. Appl. No. 15/835,245 dated Jan. 10, 2019.

U.S. Notice of Allowance for U.S. Appl. No. 16/057,711 dated Apr. 2, 2019.

U.S. Supplemental Notice of Allowability for U.S. Appl. No. 15/835,245 dated Oct. 1, 2019.

U.S. Corrected Notice of Allowability for U.S. Appl. No. 15/873,530 dated Oct. 18, 2019.

U.S. Corrected Notice of Allowability for U.S. Appl. No. 15/873,530 dated Nov. 12, 2019.

(56) References Cited

OTHER PUBLICATIONS

U.S. Notice of Allowance for U.S. Appl. No. 16/057,711 dated Sep. 17, 2019.
U.S. Non-Final Office Action for U.S. Appl. No. 16/224,604 dated Oct. 22, 2019.

CONTROL OF ELECTRODYNAMIC SPEAKER DRIVER USING A LOW-ORDER NON-LINEAR MODEL

CROSS-REFERENCE TO RELATED APPLICATIONS

This application claims the priority benefit of U.S. Provisional Patent Application Ser. No. 62/271,590, filed Dec. 28, 2015, which is incorporated herein by reference in its entirety.

TECHNICAL FIELD

One or more embodiments relate generally to linearization of loudspeakers, and in particular, to linearization of loudspeakers based on nonlinear control of cone motion.

BACKGROUND

A loudspeaker is nonlinear by design and produces harmonics, intermodulation components and modulation noise. Nonlinear distortion impairs music quality and speech intelligibility. Industrial design constraints demand smaller speaker systems without sacrificing the sound output level and quality. This results in higher distortion.

SUMMARY

One or more embodiments relate to linearization of loudspeakers based on nonlinear control of cone motion. In some embodiments, a speaker system includes a speaker driver configured to cause speaker cone displacement based on a driver voltage input. A controller is configured to generate the driver voltage input to the speaker driver. The controller includes: a feedforward control path configured to generate a nominal voltage input based on a nonlinear model of electroacoustic dynamics of the speaker driver and an input audio signal.

In some embodiments, a non-transitory processor-readable medium that includes a program that when executed by a processor performs a method comprising: generating a driver voltage input to a speaker driver. Generating the driver voltage input comprises generating a nominal voltage input based on a nonlinear model of electroacoustic dynamics of the speaker driver and an input audio signal. Speaker cone displacement is caused based on the driver voltage input.

In some embodiments, a method includes generating a driver voltage input to a speaker driver. Generating the driver voltage input comprises generating a nominal voltage input based on a nonlinear model of electroacoustic dynamics of the speaker driver and an input audio signal. Speaker cone displacement is caused by the driver voltage input.

These and other features, aspects and advantages of the one or more embodiments will become understood with reference to the following description, appended claims and accompanying figures.

DETAILED DESCRIPTION

Figure 1:
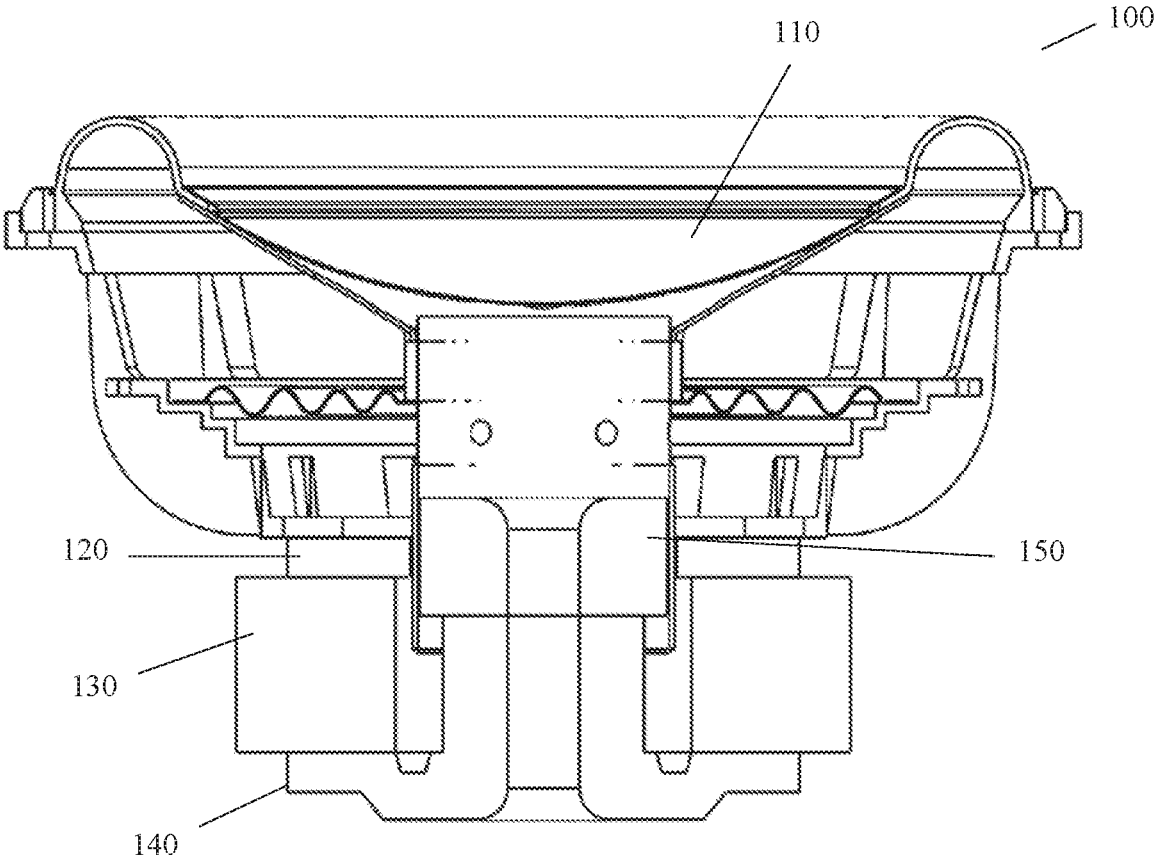
FIG. 1 shows an example transducer without a shorting ring.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments provide for linearization of loudspeakers based on nonlinear control of cone motion. In some embodiments, a speaker system includes a speaker driver configured to cause speaker cone displacement based on a driver voltage input. A controller is configured to generate the driver voltage input to the speaker driver. The controller includes: a feedforward control path configured to generate a nominal voltage input based on a nonlinear model of electroacoustic dynamics of the speaker driver and an input audio signal.

In one or more embodiments, a linearization of a loudspeaker (or speaker driver) is achieved by nonlinear control of speaker cone motion. At each time instant, some embodiments calculate the input voltage value that produces a targeted displacement of the membrane of the cone and thus the intended sound wave. The operation for some embodiments may include:

a target cone displacement is derived from the desired sound pressure (e.g., determined from the sound stream, sound data file, etc.);

a model of an electroacoustic system (e.g., a driver plus enclosure) is used to calculate a nominal voltage (feedforward control) to obtain the target displacement;

monitoring the current drawn to estimate the actual cone displacement; and/or the difference between the target and estimate of the actual (effective) cone displacement is used to determine a correction voltage, which is added to the feedforward control voltage. That correction voltage compensates for model inaccuracies (e.g., variations of samples of the speaker system, such as manufacturing dispersion) and drifting (e.g., driver's heating), sensing errors, exogenous disturbances on the speaker system (e.g., vibrations, actuator noise, etc.), non-zero initial states, etc.

In some embodiments, a speaker/sound driver with optimized characteristics is used to simplify real-time computations and digital control and includes a smooth force factor Bl(x), where x is the cone displacement, smooth mechanical stiffness K(x) and constant voice-coil inductance (over a useful range of cone displacement within the mechanical limits).

Some embodiments have the features over conventional loudspeaker systems of controlling voltage that eliminates the need of separate current and voltage sources, an overall simpler system design, better performances in term of nonlinear distortion and power consumption, compensates distortion effectively and cone displacement control protects loudspeakers against excessive displacement and overheating.

Creating smaller sized speaker systems can result in higher distortion. One or more embodiments described herein may serve as an anti-distortion system to achieve small-sized speaker systems. In some embodiments, a speaker system includes a control system that performs linearization of a loudspeaker (or driver) that includes a voice coil and has an inductance that is constant with respect to cone displacement. Some embodiments employ linearization processes, which may include flatness-based approaches, output and/or state feedback linearization, a Volterra-model based nonlinear compensator, a mirror filter, etc. In some embodiments, linearization is achieved, e.g., by nonlinear control of the driver's cone motion. At each time instant, the control system calculates the input voltage value that produces a targeted displacement of the cone and thus the intended sound wave.

FIG. 1 shows an example transducer 100 without a shorting ring. Conventional speaker systems or drivers may include a nonlinear control system, a driver and a transducer (current sensor). The transducer 100 includes a diaphragm 110, a top plate (e.g., steel plate) 120, a magnet 130, a bottom plate (e.g., steel plate) 140 and a voice coil 150. A conventional nonlinear controller receives audio input and generates a driver voltage for the speaker driver (herein, driver and transducer can be referred to as a "speaker"). The applied driver voltage causes a voice coil 150 of the transducer 100 to move the speaker cone including the diaphragm 110, which produces sound. The driver voltage and the movement of the voice coil results in a level of current to flow through the driver. The current is sensed and is provided to the nonlinear controller as feedback. The sensed current feedback is used to accurately actuate the speaker transducer and reduce the effects of speaker distortion.

Distortion is caused by the physical design of the speakers and produces harmonics, intermodulation components and modulation noise. Distortion can negatively affect the quality of the sound and, in particular, can limit the quality of the bass that can be achieved by the speaker. While all speakers have a level of distortion, certain design consideration, such as size, may tend to increase the amount of distortion. For example, industrial design constraints demand smaller speaker systems, which can increase the amount of distortion, without sacrificing the sound output level and quality.

Speaker distortion can be caused by a number of factors affecting the dynamics of the driver and transducer, which are described below in connection with FIG. 3. One source of distortion is from a nonlinearity of the inductance of the voice coil 150. As the voice coil 150 changes position, it can have different inductance. This type of nonlinearity can be called positional inductance of the voice coil 150. All other distortion can be called secondary distortion, where the term secondary does not denote importance or strength and is merely a designation that the nonlinearities/distortions are different from positional inductance.

The approach of conventional nonlinear controlled speakers, such as the transducer 100, is to reduce the effects of distortion by generating an appropriate driver voltage that actuates the driver and transducer 100 in a way that counters the deleterious components of the distortion. In other words, nonlinearities in the transducer are treated by generated driver voltage at the input of the speaker to reduce the distortions at the output of the speaker. It can achieve this by including a model of the nonlinearities in the nonlinear controller and using the model (or the inverse of the model) to determine the input to the model that would generate the desired output. The transducer 100 may include a conventional nonlinear controller that includes a positional inductance compensator and a secondary distortions compensator, which include the models of the positional inductance nonlinearities and the secondary nonlinearities. This approach is an active approach, meaning that the system uses energy (in the form of the driver voltage) to reduce distortion.

Figure 2:
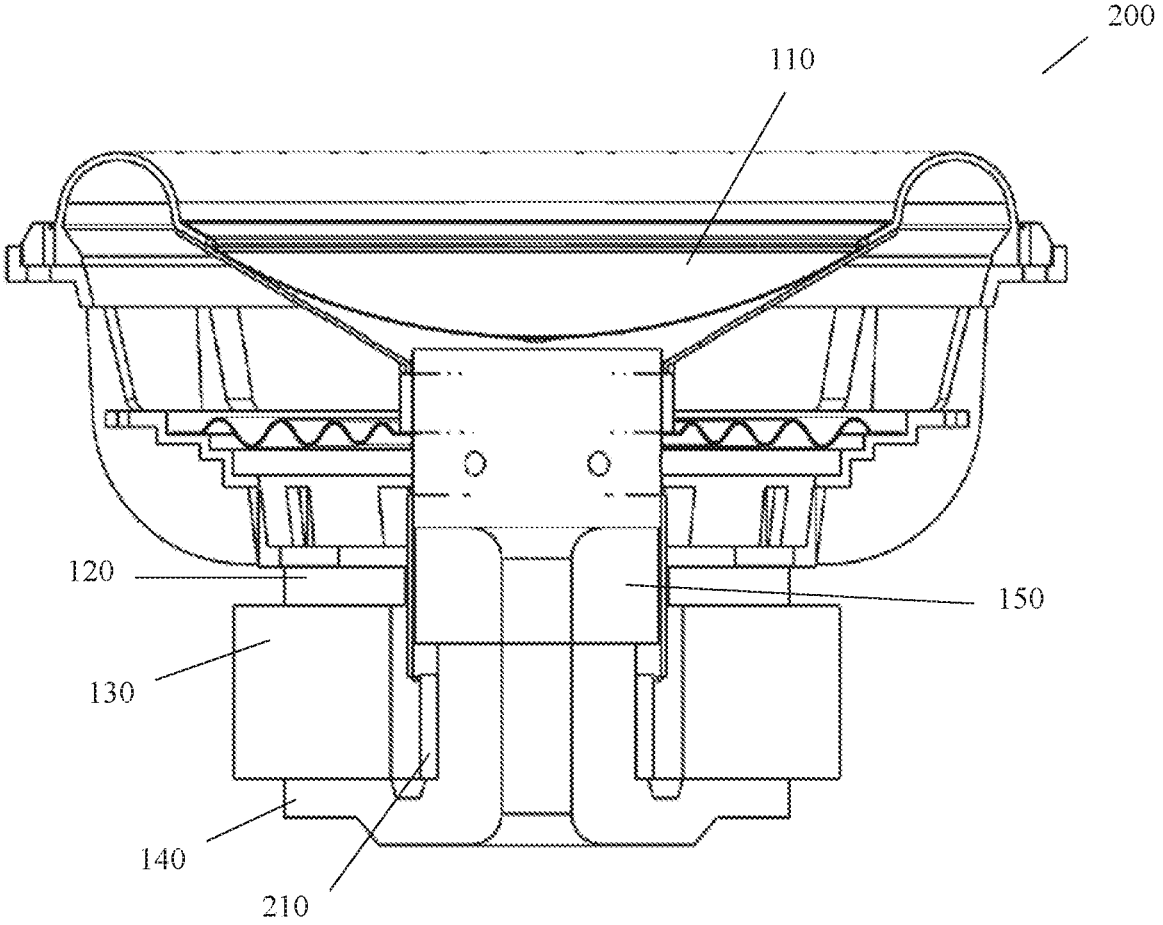
FIG. 2 shows the example transducer of FIG. 1 including a shorting ring.

FIG. 2 shows a transducer 200, which is similar to the transducer 100 of FIG. 1, but includes a shorting ring 210. The shorting ring 210 is a passive positional inductance compensator. Note that the shorting ring 210 does not influence the system through the driver voltage. Instead, it directly compensates by coupling electromagnetically with the voice coil (enabling the voice-coil to achieve substantially constant inductance in accordance with some of the embodiments described below).

Figure 3:
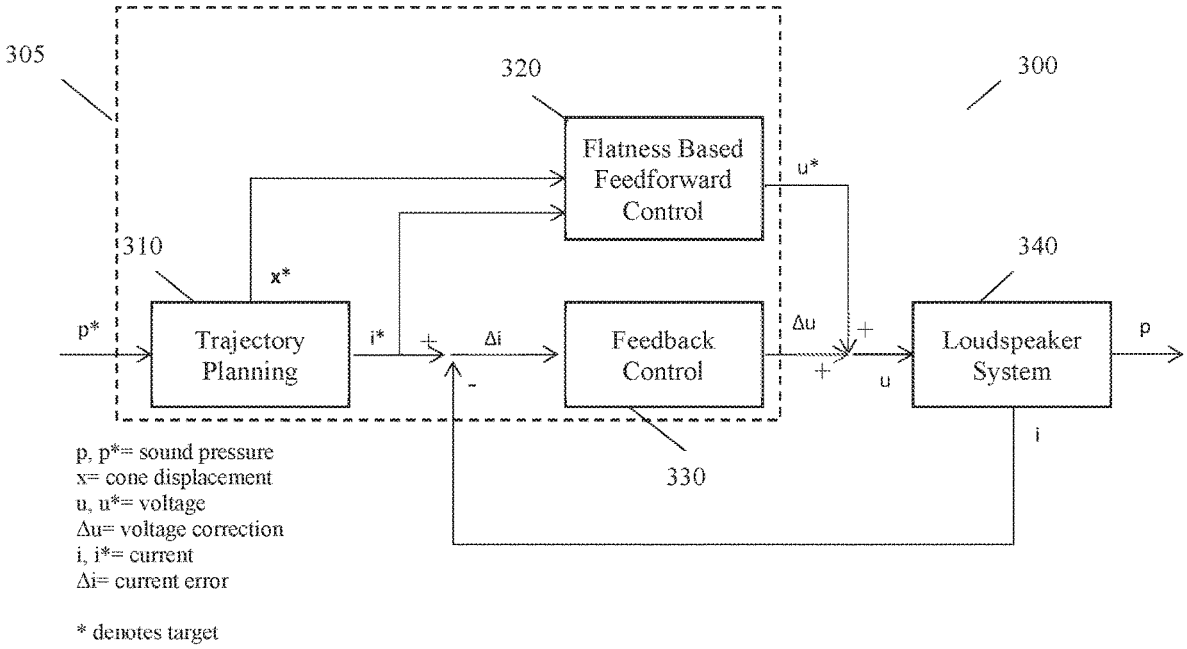
FIG. 3 shows a block diagram of components of a speaker system, according to some embodiments.

FIG. 3 shows a block diagram of components of a speaker system 300, according to some embodiments. In some embodiments, the speaker system 300 includes a nonlinear control system (or controller) 305 that includes flatness based feedforward control 320, feedback control 330 and a trajectory planning block 310, and a loudspeaker system (or driver system) 340. In some embodiments, having constant inductance simplifies the nonlinear control system 305 in a way that the nonlinear controller system 305 can effectively compensate the secondary nonlinearities.

In some embodiments, the nonlinear control system 305 may be embodied, in whole or in part, by a device that includes the loudspeaker system 340. In some embodiments, the whole nonlinear control system 305 may be embodied by a device that includes the loudspeaker system 340. In some embodiments, one or more of the components of the nonlinear control system 305 may be embodied by a separate device that is communicatively coupled with the device that includes the loudspeaker system 340.

In some embodiments, the nonlinear control system 305 deploys a process, algorithm, etc., that corresponds to a time-domain nonlinear feedback control based on differential flatness (by the flatness based feedforward control 320) and trajectory planning (by the trajectory planning block 310). In some embodiments, trajectory planning provided by the trajectory planning block includes setting the target sound pressure as proportional as the music or program material (e.g., the digital signal of the audio data representative of the acoustic waveform to be generated) and derives the target cone displacement (sometimes referred to as cone excursion) from the target sound pressure (e.g., by performing double integration). The displacement is used as the flat (linearizing) output of the loudspeaker system 340. In some embodiments, a nominal current (i.e., the target current provided by the trajectory planning block 310) is derived from it using the following equation:

$$i=(K(x)x+R_{ms}\dot{x}+M\ddot{x})/Bl(x).$$

where:

x target cone displacement,

K(x) stiffness of the cone suspension,

Rms mechanical resistance of the cone suspension,

M mechanical moving mass of the voice-coil and cone,

Bl(x) force-factor of the voice-coil

In some embodiments, the derivatives are determined directly in the time domain with eventually some low-pass filtering.

In some embodiments, the flatness based feedforward control 320 provides calculating a nominal control voltage (e.g., feedforward control) from the displacement using the nonlinear model of the electroacoustic system (driver plus enclosure) and flatness approach. This voltage produces the target displacement under nominal conditions (exact model) using the following equation:

$$u = Bl(x)\dot{x} + R_e i + L_0 \frac{di}{dt}$$

where:

u is voltage, i is current,

Bl(x) is a force factor of the voice-coil $R_e$ electrical resistance of the voice-coil, $L_0$=L(x=0), electrical inductance of the voice coil at rest position.

In some embodiments, the loudspeaker system 340 includes a driver with optimized characteristics and its enclosure. The driver receives a voltage as an input. Based on the input voltage, the driver actuates a voice coil actuator that causes a cone displacement x.

In some embodiments, the feedback control block 330 provides for monitoring the input current (i.e., the measured current drawn by the speaker driver system 340). The difference between the input current (i.e., the measured current drawn by the speaker driver system 340) and the nominal current (i.e., the target current generated by the trajectory planning block 310) is used to determine a correction voltage which is added to the feedforward control voltage. That correction voltage compensates for model inaccuracies (e.g., variations of samples of the loudspeaker system 340 (e.g., due to manufacturing dispersion, unmodeled dynamics and drifting (e.g., driver heating, driver aging, climate changes), sensing errors, exogenous disturbances on the loudspeaker system 340 (e.g., vibrations, room response, non-zero initial states, etc.) In some embodiments, the feedback control block 330 may be implemented using the following equation:

$$\Delta u = R\Delta i + L\frac{d(\Delta i)}{dt}$$

and includes several terms. In some embodiments, the terms may include proportional-integral-derivative terms with respect to the current error signal Δi, linear and/or nonlinear terms comprising the model dynamics of the loudspeaker system 340 (e.g., to cancel out the dynamics of the loudspeaker), a nonlinear damping term, and/or the like.

In some embodiments, the nonlinear control system 305 model parameters K(x), Rms, M, Bl(x), $R_e$, and $L_0$ may be stored in memory (not shown) coupled to the nonlinear control system 305. In some embodiments, K(x) and Bl(x) may be stored as either lookup tables or as closed form functions.

In some embodiments, the loudspeaker system 340 provides for a driver with optimized characteristics to simplify real-time computations and digital control: smooth force factor Bl(x), smooth mechanical stiffness K(x) and constant (or substantially constant) voice-coil inductance (e.g., constant inductance, or a predefined range of inductance, over a useful range of cone displacement within the mechanical limits). Constant inductance (or substantially constant inductance) may be achieved in the magnetic structure of the loudspeaker system 340 through several ways including:

- operating the magnetic structure such that the metal (e.g., steel) is saturated with magnetic flux and therefore more immune to the changing magnetic field generated by the voice-coil;
- adding conductive, non-ferrous (e.g., copper, aluminum, etc.) rings above, below, or inside the magnetic air gap in a configuration that results in a constant inductance;
- adding a thin copper cap or plating onto the surfaces of the central metal pole piece, over the top plate, or both;
- use of an additional fixed coil positioned in the magnetic air gap with two (2) terminals allowing active compensation by applying a current in the opposite direction of the voice-coil current; or
- using of two or more of the above together.

In some embodiments, the nonlinear control system 305 may be applied to many different types of electrodynamic transducers and therefore has a broad range of applications (e.g., TV, sound bars, wireless speakers, mobile phones, etc.). The nonlinear control system 305 facilitates a higher level of reproduction, better sound quality and mechanical protection of transducers.

Some embodiments may implement the following:

- fractional order dynamics included in the nonlinear control system 305 model and feedback control 330 (e.g., fractional proportional integral derivative (PID) control);
- the flat output used for trajectory planning does not need to be displacement, where some embodiments may additionally and/or alternatively use another loudspeaker dynamic parameter (e.g., displacement, velocity, current, voltage, etc.) or a combination of parameters and their time derivatives;
- different kinds of feedback control may be used (e.g., PID, adaptive control, state feedback, linear-quadratic-regulator control, linear-quadratic-Gaussian control, multivariable robust control (H-infinity loop shaping control, mu-synthesis control, loop transfer recovery control), etc.);
- the loudspeaker system 340 model may be time dependent and/or gain controlled to take in account model drifting (e.g., thermal model);
- the principle of flatness based control may be extended to control drivers with non-constant inductance L(x,i) function of position and current; and/or
- the program material to be reproduced may be equalized beforehand, for example to enhance the bass content.

Figure 4:
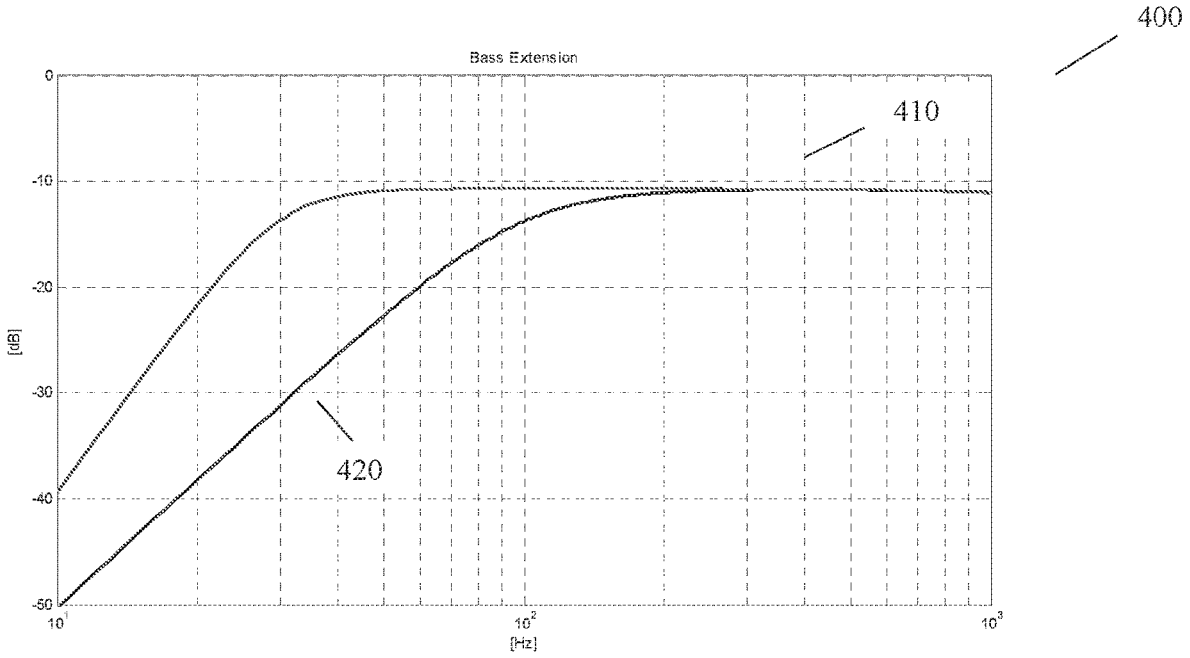
FIG. 4 shows an example graph of bass extension, according to some embodiments.

FIG. 4 shows an example graph 400 of bass extension, according to some embodiments. As shown, the graph 400 includes an equalized bass extension 410 and a raw bass extension 420 for comparison. In this example a gain up to 20 dB is obtained at frequencies below 100 Hz.

Figure 5:
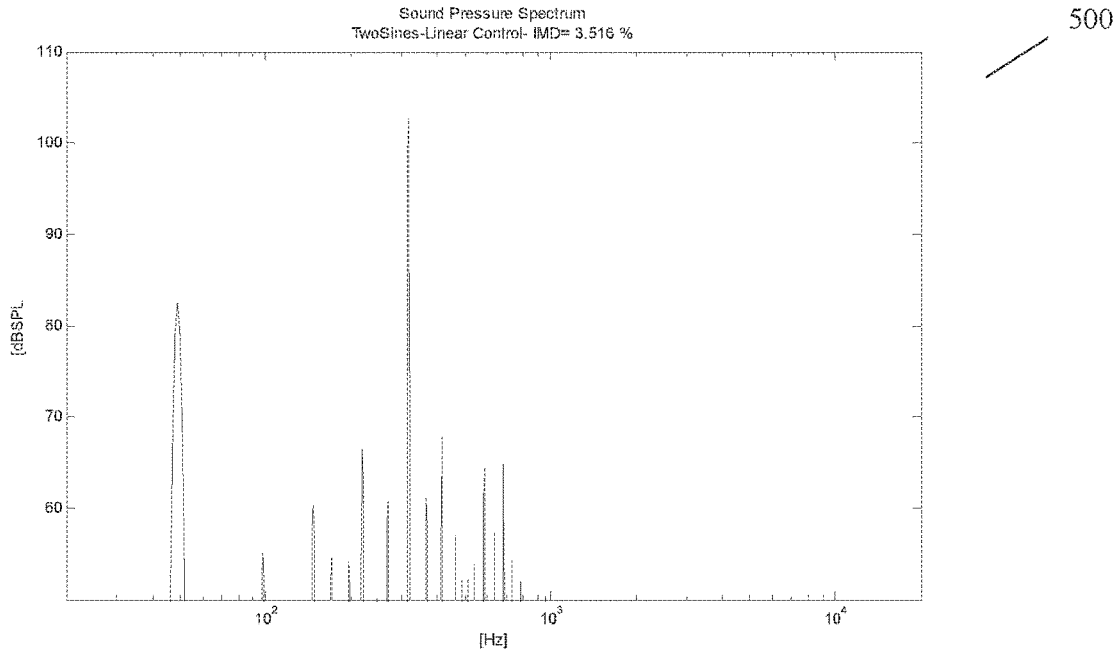
FIG. 5 shows an example graph of a response for a loudspeaker system without anti-distortion.

FIG. 5 shows an example graph 500 of a response for a loudspeaker system 340 without anti-distortion. The excitation signal (voltage input) which consist in a bass tone (~50 Hz) and a voice tone (~300 Hz) result in a multitude of intermodulation products due to the loudspeaker nonlinearity.

Figure 6:
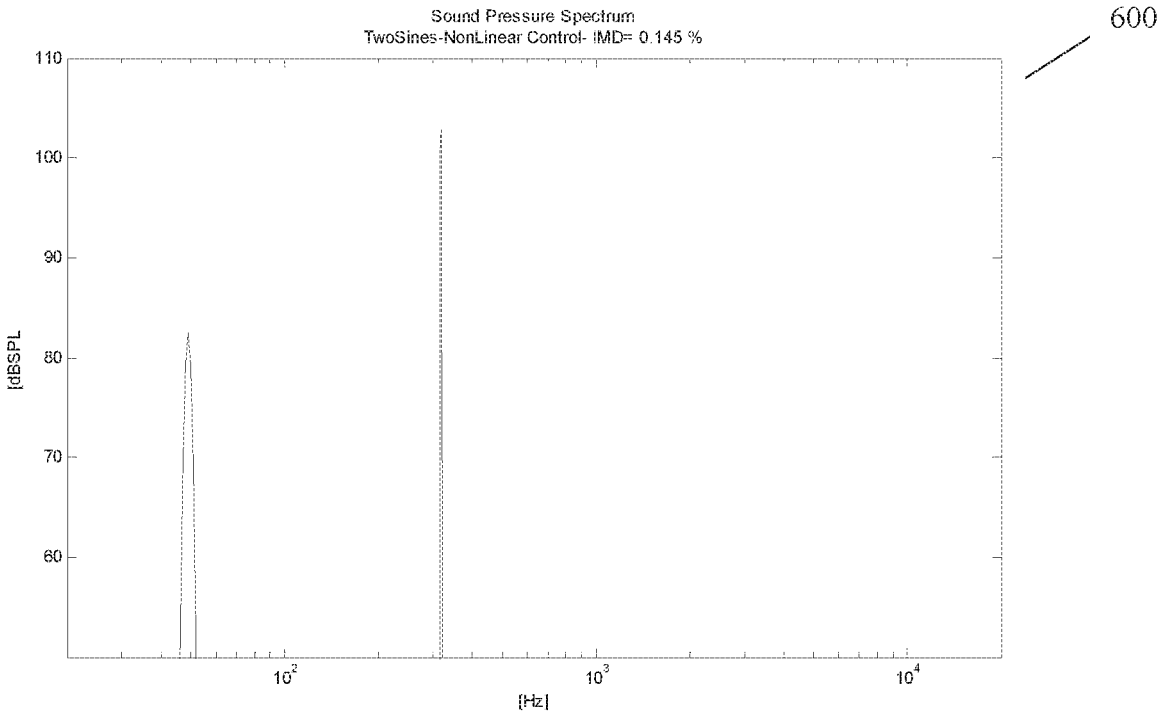
FIG. 6 shows an example graph of a response for a loudspeaker system using anti-distortion, according to some embodiments.

FIG. 6 shows an example graph 600 of a response for the loudspeaker system 340 using anti-distortion, according to some embodiments. The intermodulation products have been greatly attenuated and are no more visible in the graph.

Figure 7:
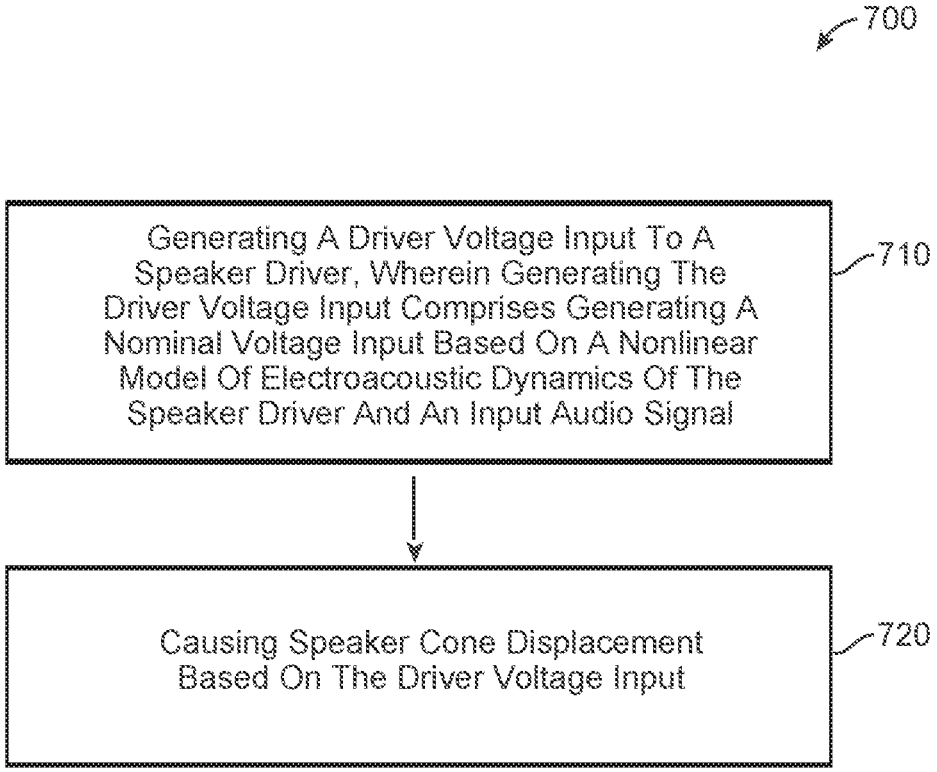
FIG. 7 shows a block diagram of a process for linearization of loudspeakers based on nonlinear control of cone motion, according to some embodiments.

FIG. 7 shows a block diagram of a process 700 for linearization of loudspeakers based on nonlinear control of cone motion, according to some embodiments. In some embodiments, block 710 provides generating (e.g., by controller 305, FIG. 3) a driver voltage input to a speaker driver (e.g., loudspeaker system 340). Generating the driver voltage input includes generating a nominal voltage input (e.g., by feedforward control 320) based on a nonlinear model of electroacoustic dynamics of the speaker driver and an input audio signal. Block 720 provides causing (e.g., by loudspeaker system 340) speaker cone displacement based on the driver voltage input.

In some embodiments, process 700 may further include adjusting the driver voltage input based on a feedback control path (e.g., feedback control 330). Process 700 may additionally include adjusting (e.g., by feedback control 330) the driver voltage input by generating a correction voltage based on a comparison of a target current and a measured current drawn by the speaker driver, where the driver voltage input is a sum of the nominal voltage input and the correction voltage. Process 700 may also include generating (e.g., by trajectory planning block 310) a target cone displacement based on the input audio signal, generating (e.g., by trajectory planning block 310) the target current based on the target cone displacement, and generating (e.g., by feedforward control 320) the nominal voltage input to the speaker driver based on the target cone displacement, the target current and the flatness process that includes determining the nominal voltage based on a function of the target displacement and its time derivatives, the target current and at least one derivative of the target current with respect to time.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the claims to an element in the singular is not intended to mean "one and only" unless explicitly so stated, but rather "one or more." All structural and functional equivalents to the elements of the above-described exemplary embodiments that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A speaker system comprising:

a speaker driver configured to cause speaker cone displacement based on a driver voltage input; and a controller configured to generate the driver voltage input to the speaker driver, the controller comprising:

a feedforward control path configured to generate a nominal voltage input based on a nonlinear model of electroacoustic dynamics of the speaker driver and an input audio signal; and a trajectory planning block configured to:

generate a target cone displacement based on the input audio signal; and determine a target current based on the target cone displacement.

2. The speaker system of claim 1, the controller further comprising a feedback control path configured to adjust the driver voltage input.

3. The speaker system of claim 2, wherein the feedback control path is configured to adjust the driver voltage input by generating a correction voltage based on a comparison of a target current and a measured current drawn by the speaker driver, wherein the driver voltage input is a sum of the nominal voltage input and the correction voltage.

4. The speaker system of claim 1, wherein the feedforward control path is further configured to use the target cone displacement and the target current to generate the nominal voltage input to the speaker driver.

5. The speaker system of claim 4, wherein the feedforward control path uses a flatness process to determine the nominal voltage based on a function of the target displacement and its time derivatives, the target current and at least one derivative of the target current with respect to time.

6. The speaker system of claim 1, wherein the speaker driver has a substantially constant voice-coil inductance over an operating range of cone displacement, and the speaker driver comprises characteristics that simplify real-time computations and digital control based on a force factor Bl(x), mechanical stiffness K(x) and constant voice-coil inductance, where x is cone displacement.

7. The speaker system of claim 1, wherein the feedback control path adjusts the nominal voltage input based on at least one of: proportional terms, integral terms, or derivative terms of an error between the target current and the measured current.

8. The speaker system of claim 1, wherein the feedback control path implements at least one of: proportional integral derivative (PID) control, adaptive control, state feedback, linear-quadratic-regulator control, linear-quadratic-Gaussian control, and multivariable robust control.

9. The speaker system of claim 1, wherein the speaker driver has a non-constant voice-coil inductance.

10. A non-transitory processor-readable medium that includes a program that when executed by a processor performs a method comprising:

generating a driver voltage input to a speaker driver, wherein generating the driver voltage input comprises generating a nominal voltage input based on a nonlinear model of electroacoustic dynamics of the speaker driver and an input audio signal;

generating a target cone displacement based on the input audio signal;

determining, by a trajectory planning block, a target current based on the target cone displacement; and causing, by the trajectory planning block, speaker cone displacement based on the driver voltage input.

11. The non-transitory processor-readable medium of claim 10, wherein the method further comprises using the target cone displacement and the target current for generating the nominal voltage input to the speaker driver.

12. The non-transitory processor-readable medium of claim 10, wherein the method further comprises adjusting the driver voltage input based on a feedback control path.

13. The non-transitory processor-readable medium of claim 12, wherein adjusting the nominal voltage input comprises comparing a target current and a measured current drawn by the speaker driver.

14. The non-transitory processor-readable medium of claim 10, wherein the speaker driver has a substantially constant voice-coil inductance over an operating range of cone displacement, and the speaker driver comprises characteristics that simplify real-time computations and digital control based on a force factor Bl(x), mechanical stiffness K(x) and constant voice-coil inductance, where x is cone displacement.

15. A method comprising:

generating a driver voltage input to a speaker driver, wherein generating the driver voltage input comprises generating a nominal voltage input based on a nonlinear model of electroacoustic dynamics of the speaker driver and an input audio signal;

generating a target cone displacement based on the input audio signal;

generating, by a trajectory planning block, a target current based the target cone displacement; and causing, by the trajectory planning block, speaker cone displacement based on the driver voltage input.

16. The method of claim 15, further comprising adjusting the driver voltage input based on a feedback control path.

17. The method of claim 16, further comprising:

adjusting the driver voltage input by generating a correction voltage based on a comparison of a target current and a measured current drawn by the speaker driver, wherein the driver voltage input is a sum of the nominal voltage input and the correction voltage.

18. The method of claim 15, wherein the speaker driver has a substantially constant voice-coil inductance over an operating range of cone displacement, and the speaker driver comprises characteristics that simplify real-time computations and digital control based on a force factor Bl(x), mechanical stiffness K(x) and constant voice-coil inductance, where x is cone displacement.

* * * * *